US008312930B1

(12) United States Patent
Glass

(10) Patent No.: US 8,312,930 B1
(45) Date of Patent: Nov. 20, 2012

(54) APPARATUS AND METHOD FOR WATER WELL CLEANING

(75) Inventor: Jeffrey Glass, Camarillo, CA (US)

(73) Assignee: Hydropressure Cleaning, Inc., Camarillo, CA (US)

( * ) Notice: Subject to any disclaimer, the term of this patent is extended or adjusted under 35 U.S.C. 154(b) by 0 days.

(21) Appl. No.: 13/404,525

(22) Filed: Feb. 24, 2012

Related U.S. Application Data

(60) Provisional application No. 61/494,489, filed on Jun. 8, 2011.

(51) Int. Cl.
*E21B 37/00* (2006.01)

(52) U.S. Cl. ..... 166/312; 166/223

(58) Field of Classification Search ..... 134/168 C; 166/222–223, 311–312
See application file for complete search history.

(56) References Cited

U.S. PATENT DOCUMENTS

| | | | | |
|---|---|---|---|---|
| 3,326,288 | A * | 6/1967 | Pittman | 166/290 |
| 4,037,661 | A | 7/1977 | Ford | |
| 4,040,486 | A | 8/1977 | Kirkland, Jr. | |
| 4,612,986 | A | 9/1986 | Fosdick, Jr. et al. | |
| 5,060,725 | A | 10/1991 | Buell | |
| 5,072,796 | A * | 12/1991 | Shen et al. | 175/340 |
| 5,419,397 | A | 5/1995 | Reynolds et al. | |
| 5,603,378 | A * | 2/1997 | Alford | 166/222 |
| 6,059,202 | A | 5/2000 | Zink et al. | |
| 6,745,839 | B1 | 6/2004 | Simpson | |
| 6,832,655 | B2 | 12/2004 | Ravensbergen et al. | |
| 7,296,627 | B2 | 11/2007 | Dyer | |
| 2004/0089450 | A1 * | 5/2004 | Slade et al. | 166/298 |
| 2004/0134651 | A1 | 7/2004 | Challacombe | |
| 2008/0185150 | A1 | 8/2008 | Brown | |
| 2011/0108636 | A1 * | 5/2011 | Wright | 239/251 |
| 2012/0018163 | A1 * | 1/2012 | Nelson et al. | 166/312 |

OTHER PUBLICATIONS

Technical sheet regarding NPT pipe threads, 2006 Jetstream of Houston, LLP, Houston, TX.
http://wiki.answers.com/Q/What_is_the_working_pressure_for_NPT_threads.
Houben & Treskatis, Water Well Rehabilitation and Reconstruction, 2007, pp. 85-86 & 216-220, McGraw Hill, US.
Sterrett, Groundwater & Wells 3rd ed., 2007, pp. 516-519, Johnson Screens, a Weatherford Company, US.

* cited by examiner

*Primary Examiner* — Giovanna Wright
(74) *Attorney, Agent, or Firm* — Ralph D. Chabot

(57) ABSTRACT

A method and apparatus for cleaning a water well is presented. The apparatus utilizes a tool body having a plurality of discharge nozzles for jetting streams of filtered water at high pressure on to the inside wall surface of a casing across a water zone having slots or perforations. The nozzle streams are offset from the tool body imparting a rotational force. A rotary coupling is also utilized to limit the maximum rotation. The apparatus is lowered by a pre-determined length of coiled tubing to cleaning depth after which it is raised at a slow rate across the water zone.

25 Claims, 3 Drawing Sheets

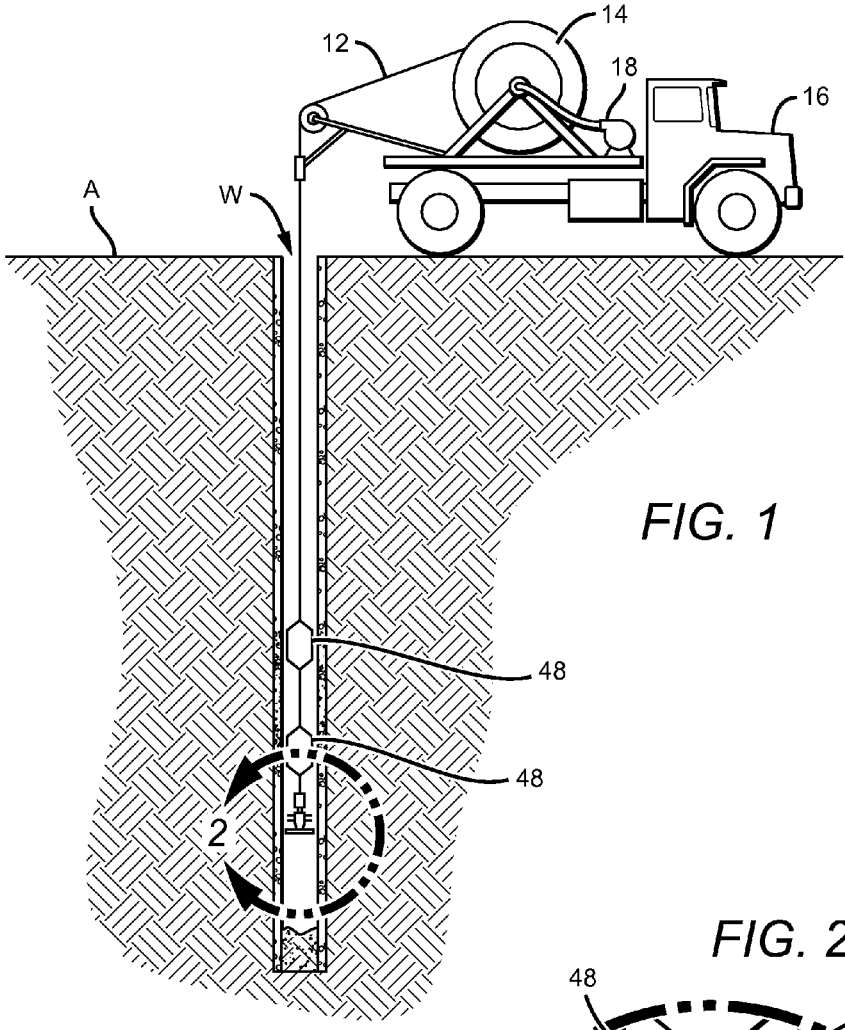
FIG. 1
FIG. 2
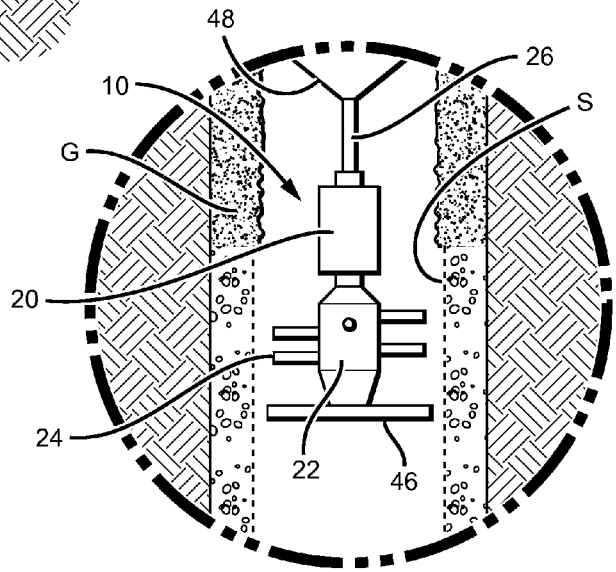

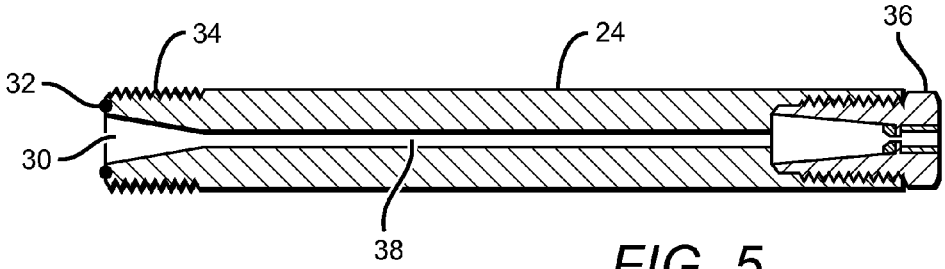
FIG. 5
FIG. 6a
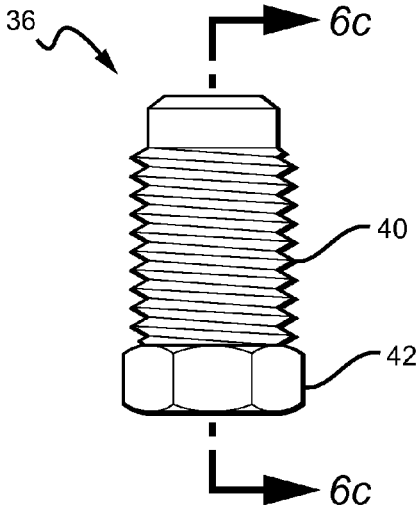
FIG. 6b
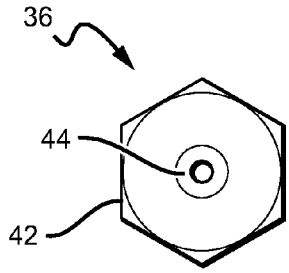
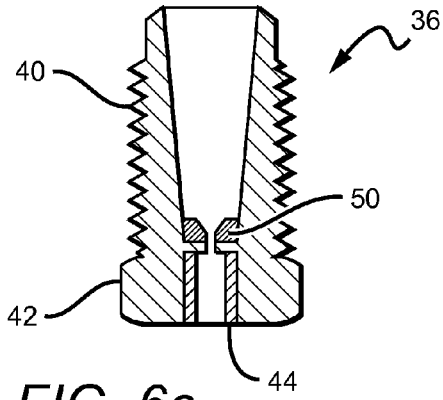
FIG. 6c

APPARATUS AND METHOD FOR WATER WELL CLEANING

BACKGROUND OF THE INVENTION

This invention relates to rehabilitation of existing water wells.

Water wells are created by drilling from the surface of the earth down into a water producing zone(s). The drilled hole is cased with a suitable string of steel or PVC casing from surface down through the water zone. Typical installations can have the diameter of the casing through the water zone be from six to sixteen inches or more. The portion of the casing adjacent the water zone is typically perforated with holes or machine slots to allow water entry into the casing. After the casing has been set and depending upon the water zone strata, a clean porous zone of gravel can be pumped and set around the slotted or perforated section of the casing, also referred to as the gravel packed area, out to the lining of the well bore. The purpose of the gravel pack is to filter out the fine sediment from the surrounding formation, while allowing the water to enter into and through the perforated well casing.

After a period of time, and due to a variety of different reasons, the slotted or perforated well casing, and possibly the gravel pack can become plugged with material such as calcium carbonate, iron bacteria, etc. An early indication of plugging is a deterioration of specific output capacity of the well. Well rehabilitation companies and well owners alike quantify this deterioration by measuring the amount of drawdown reported in units of gallons per foot of drawdown (gpm/ft) over a period of time. As drawdown deteriorates over time, the decision is made to rehabilitate the well using any of various methods well known in the prior art. These methods include acid washes, reperforating the portion of the casing across the water zone and scrapers to scrape scale build-up about the inner wall circumference of the casing. Methods also include utilizing a low pressure jet spray which washes the plugging material with water or water in combination with an acid.

One example of prior art well cleaning with a jet spray is disclosed in U.S. Pat. No. 5,060,725 issued to Buell. Buell teaches the use of sufficient hydraulic horsepower to supply a plurality of jet nozzles with at least 0.77 barrels per minute per jet nozzle to clean perforation tunnels in a well casing or liner.

Although perhaps suitable for oil well cleaning, with respect to water well cleaning the quantity of fluid being introduced by Buell down hole is not recommended or commercially used today. The reasoning is that introduction of such a great volume of water could potentially include unintended contaminants as well as the volume of the wash disrupting the integrity of the gravel pack.

Another example of prior art well cleaning is disclosed in U.S. Pat. No. 5,060,725 issued to Alford. Alford teaches a well cleaning tool comprising a jetting tool used in combination with a surge block. This reference, in respect to use of the jet nozzles, teaches away from cleaning gravel pack screens directly and instead uses the radially orientated jet nozzles to turbulently clean the inside wall of a casing.

SUMMARY OF THE INVENTION

My invention is an apparatus and method for cleaning water wells which avoids the use of harmful chemicals or abrasives and instead, uses low water volume but at high pressure to blast scale and other deposits. The tool of the present invention is used primarily when it is determined that there is a need to clean or open apertures which, over time, have become partially or fully closed as a result of bacteria or incrustations which are untreatable using less time consuming or less invasive methods. Because no chemicals or abrasive material are used, the environmental quality of water produced subsequent to well rehabilitation is not negatively impacted.

As is well known in the art, down hole wells may contain perforations, slots, or screens. As is used in this specification, the term "perforation" is defined to include any hole, screen or other conduit for flow of water from the at-depth strata entering into a well casing.

The term "about" as used in this specification is defined to mean plus or minus 5 percent of the value specified.

Typically, the wells intended for use with my invention are wells where a final attempt is made to improve production rate before either acquiescing and accepting the low production or where the well may be abandoned and replaced by drilling a new well.

The high pressure discharge, at a relative low flow rate through each nozzle, delivers a water jet stream with sufficient energy to not only clean the casing wall of build-up but also impart a cleaning force through the perforations and into the gravel pack.

My method comprises the use of a down hole tool which is lowered into a water well preferably using a pre-determined length of coiled tubing such as either stainless steel coiled tubing or a wire-reinforced thermoplastic impregnated hose. The pre-determined length must be sufficient to lower the tool to the necessary depth. The down hole tool is appropriately sized to pass through the inside diameter of the lowermost casing string.

The conduit used must be capable of withstanding a high pressure application of over 15,000 psi. The tubing or hose used will have an appropriate inside diameter for the depth of the well to be cleaned. Preferably, the inside diameter used for wells less than 1000 ft in depth is at least 20 mm and for wells in excess of 1000 ft, at least 24 mm; or, an inside diameter which is capable of discharging water at the necessary well depth from a plurality of discharge nozzles at pressures exceeding 15,000 psi.

It has been determined the pressure at the discharge of each nozzle should be at least 15,000 psi in order to effectively clean the casing and surrounding gravel pack. The flow rate passing through each nozzle is limited to between about 5.0-7.0 gpm.

The down hole tool is supported from the coiled tubing/hose using an appropriate length of rigid pipe equipped with centralizers for providing stability.

Below the rigid pipe section is a rotary coupling to retard excessive rotation. Although various rotary couplings are known in the art to control rotation, including mechanical, preferably a rotary coupling is selected which utilizes braking fluid to retard excessive rotation similar to that known in the prior art and described in U.S. Pat. No. 6,059,202. The purpose of the rotary coupling is to provide a control means for limiting the rotation of the discharge nozzles to an acceptable rate, which for the purposes of my invention, is between about 20-50 rpm.

The rotary coupling has an intake orifice, an inside diameter flow path equivalent to the intake orifice of the down hole tool and an exit orifice and is operatively attached to the down hole tool. Preferably, attached downstream of the rotary coupling is a neck which serves as a connector between the rotary coupling and down hole tool.

At this point, it should be noted that because of the down hole pressure required for proper operation of my invention, friction loss of the water traveling through the system must be kept at a minimum. Accordingly, the flow path from the discharge of the surface pump, to the down hole tool should be designed to minimize friction loss as is practicable.

The down hole tool operatively connected to the rotary coupling comprises a tool body having an inside diameter which is about the same as the coiled tubing and rotary coupling above to minimize friction loss and turbulence. Thus, the flow path from the pump to the tool body is designed to minimize turbulence and promote laminar flow.

The tool body has an intake orifice and serves to separate the pumped water into separate streams through a plurality of exit ports which feed through discharge nozzles as will be shortly described. Although the tool body design can be configured so that the discharge nozzles attach directly to the tool body, such a design would be impracticable for use in water wells having significantly different diameters, because of the proximity required between discharge nozzle and casing wall surface. Thus, in environments where only a single size of casing diameter will be encountered, the tool body could be designed so that the discharge nozzles attach directly. However, since water wells of various diameters exist, it is more practicable to design a smaller diameter tool body which can be used in most water wells and then equip the tool body with a plurality of elongated nozzle pipes, the lengths of which can be optimized for the particular diameter of the well to be cleaned.

In the preferred embodiment, the tool body comprises a plurality of exit ports each connecting to a respective nozzle pipe having a distal end fitted with a discharge nozzle. Each connection provides a water tight connection able to withstand at least 15,000 psi.

Preferably, the nozzle pipes are offset and orientated in a perpendicular or nearly perpendicular direction away from the tool body for facing the inside wall of a casing to be cleaned. Most preferably, the offset is between about 0.23 inches and 0.27 inches off the center line of the tool body. Because the nozzle pipes are offset, flow through the discharge nozzles will cause the tool body to rotate. Preferably, the number of nozzle pipes are an even number; such as six, eight or ten. Most preferably, orientation of the discharge nozzles is arranged so that each nozzle has a unique vertical position. Stated another way, the exiting streams from each nozzle contact the casing wall at a different height, if the tool body was not being displaced upward.

The distance of each discharge nozzle away from the center line of the tool body is dependent upon the inside diameter of the well to be worked upon. Thus, after the inside diameter for the specific well to be cleaned has been identified, the correct length of nozzle pipe is selected and thereafter attached to the tool body. The nozzle pipe length is selected so that the discharge nozzles, attached to the distal end of each nozzle pipe, are located between about 0.5-2.5 inches from the inside face of the casing at the known depth range for the perforations to be cleaned.

In order to prevent the discharge nozzles from contacting the casing wall, in addition to the centralizers positioned above the rotary coupling, there is also a centering disc located beneath the tool body. The centering disc has a diameter which is about 0.5 inches less than the inside diameter of the casing at-depth and has a radius which is about 0.25 inches greater than the radial extent of each discharge nozzle. Therefore, the nozzles will not come in direct contact with the casing wall which could cause damage to the nozzle array.

Besides flow rate and pressure mentioned earlier, equally important is the characteristic of the exiting flow from each discharge nozzle. Specifically, the cohesiveness of the flow from each nozzle, i.e. a laminar flow is desired to be maintained for as long a discharge distance as practical. It has been determined that fluid character upstream of the nozzle is a critical variable which is determinative of the fluid character discharged and the conditions for causing turbulent flow should be kept at a minimum.

Because of the high pressure required, most fittings are preferably metal-to-metal autoclave fittings further utilizing O-rings to not only prevent leakage at the joints but also reduce friction loss across joint interfaces. Combined with the use of coiled tubing, friction loss is minimized as the water is pumped from surface and exiting the discharge nozzles.

One additional concern addressed by my invention is the prevention of excessive and detrimental erosion which tends to occur at the discharge nozzle immediately and axially about the flow path. Because any expansion of the nozzle opening caused by erosion will reduce the discharge pressure, it is critical that the discharge nozzle be constructed of material resistant to erosion. In a preferred embodiment, the discharge nozzles incorporate a press-fit funnel constructed from either commercial grade sapphires or diamonds with a diameter of about 0.040 inches. Also, a press-fit cylindrical erosion insert preferably made from tungsten carbide is positioned on the discharge side.

With the make-up of the tubing string described, my method of use will now be described.

Filtered well water is preferably used as the cleaning fluid. This reduces the risk of contaminants being introduced into the well during the cleaning operation. Abrasives are not contemplated to be used as part of my invention and the preferred embodiment of my invention has the cleaning fluid consisting of filtered well water. Abrasive material could plug or erode the precision cut orifices. Thus, my invention cleans the down hole perforations using the force of a high pressure, substantially laminar flow stream.

At surface, a vehicle is moved into position as illustrated in FIG. 1. The tool body, nozzle pipes, neck, rotary coupling, rigid tubing, stabilizers and distal end of the coiled tubing are operatively connected together and after being pressure tested, the tool body is lowered into the well until the discharge nozzles are adjacent to and facing the lowermost casing wall to be cleaned. Once at depth, a surface pump, operatively connected to the plurality of discharge nozzles, is activated to pump filtered well water at a sufficient volume. The volume is dependent upon the number of discharge nozzles being used. With the desired flow rate being between about 5-7 gpm, the flow rate using a tool body equipped with 6 discharge nozzles would be between about 30-42 gpm; for 8 nozzles, 40-56 gpm; and for 10 nozzles, 50-70 gpm. This flow rate through the offset discharge nozzles will cause the tool body to rotate. Because of the high pressure flow being generated an appropriately designed rotary coupling, preferably utilizing breaking fluid, is operably connected to the tool body to limit the rate of rotation to between about 20-50 rpm.

During the pumping operation, the coiled hose/tubing is slowly retracted, between about 1-3 feet per minute across the perforated water zone. This retraction rate in tandem with the nozzle body rotation rate, limits the time a specific area of the casing wall is exposed to the high pressure fluid stream exiting from each discharge nozzle. The exposure time is sufficient to blast off any scale, rust or other fouling material which is present as well as allowing time for the fluid stream to penetrate past the perforations. However, the exposure time is not so prolonged to cause damage to the casing; provided the casing is in good condition. The combination of tool body rotation, slow tool retraction and high pressure output from the plurality of discharge nozzles results in all or nearly all of the inside casing wall coming in contact with the high pressure fluid discharge.

As stated earlier, the desired position of the discharge nozzles from the casing wall is between about 0.5 and 2.5 inches. Distances further than 2.5 inches would cause the integrity of the exiting stream to progressively deteriorate. Some well conditions may exist where it may not be possible to position the discharge nozzles within this range due to excessive scale or rust build-up. In these situations, it may be necessary to first run a scraper downhole and possibly run the tool body with a smaller set of nozzle pipes and center disc as an initial cleaning run.

Following the cleaning run, the pump is turned off and the tool body is retrieved. The result is that the scale, rust and other fouling material present has been blasted off the casing wall and the perforations have been opened. For optimum water production, subsequent to the cleaning run, a surge tool should be run downhole for displacing any of the blasted material which may have entered the strata by passing through a perforation during blasting. Following use of a surge tool, the blasted off material, now located at the bottom of the well, should be removed by any technique known in the art such as air-lift, foam nitrogen or by bailing.

My method for cleaning the perforations of a well having a known casing inside diameter at depth comprises the steps of:

providing a water source and a pump capable of pumping between about 50-70 gpm at a pressure in excess of 15,000 psi;

providing a retractable flow path from said pump to the downhole perforations; and, a means to deliver an even plurality of discharge streams onto the inside casing wall at a rate of between about 5-7 gpm at a pressure in excess of 15,000 psi while the rotation of said discharge streams is limited to between about 20-50 rpm. The retractable flow path comprises the string of tubing, the rotary coupling and down hole tool. The means to deliver the even plurality of discharge streams addresses the specific characteristics of both the rotary coupling and down hole tool which have been described earlier in this specification.

DESCRIPTION OF THE DRAWINGS

FIG. 1 is a side view representation of the tool positioned at depth.

FIG. 2 is a view of FIG. 1 about circle 2 of FIG. 1.

FIG. 5 is a cut away view of the nozzle pipe and discharge nozzle.

FIG. 6*a* is a side view of the discharge nozzle.

FIG. 6*b* is a face view of the discharge nozzle.

FIG. 6*c* is a cut away view of the discharge nozzle taken along line 6*c*-6*c* of FIG. 6*a*.

DETAILED DESCRIPTION OF THE PREFERRED EMBODIMENT

Figure 3:
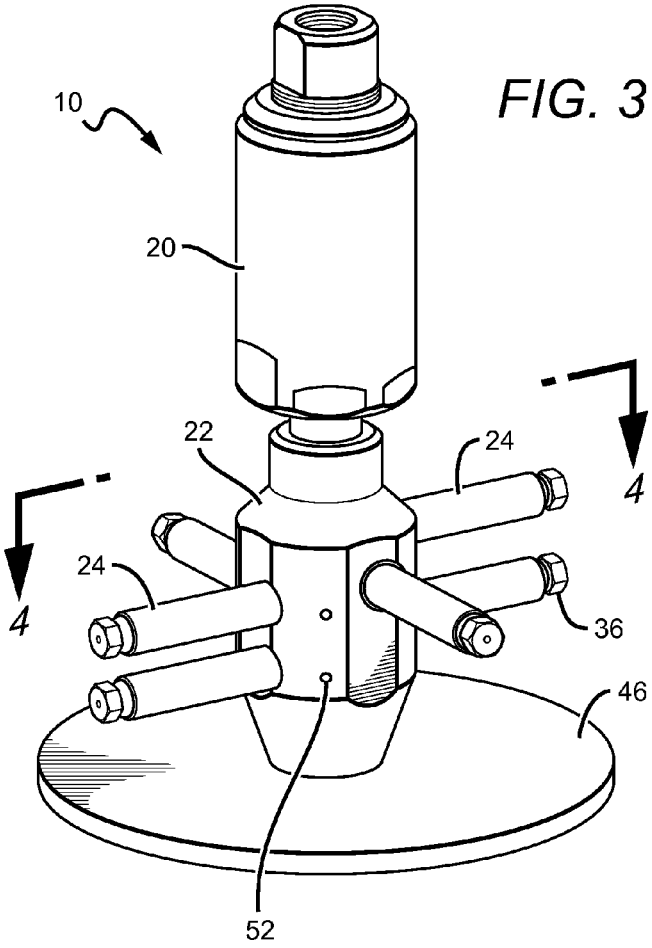
FIG. 3 is a perspective view of my primary tool.

The drawings presented are not to scale and are presented for instructional purposes.

FIG. 1 illustrates an overall view of the invention for delivery of high pressure streams of fluid into well W.

Primary tool 10 is lowered into well W down to the target depth by stainless steel coiled tubing 12 from a hydraulically driven reel 14 installed on a service vehicle 16 above surface A. Tubing 12 must be capable of withstanding a flow pressure of at least 15,000 psi. As can be best viewed in FIGS. 2 and 4, primary tool 10 is lowered to the portion of the well, which in this example is adjacent to slot perforations represented by the dashed line S, surrounded by gravel pack G.

The distal end of tubing 12 is operably connected to primary tool 10 as described later in detail. When reel 14 is used to unwind tubing 12 to lower primary tool 10 to the target depth, i.e. the lowermost portion of the well to be cleaned, which generally can be at a depth anywhere from 50 to 3,000 feet, the pumping system is thereafter activated using a 500 HP diesel driven high pressure pump 18. The feed water used to produce the high pressure nozzle discharge is local well water so as to not introduce contaminants into the well. The feed water is supplied at a rate of between 30 to 70 gallons per minute (gpm) at approximately 40 pounds per square inch through a filtration system (not shown) located upstream of pump 18.

Figure 4:
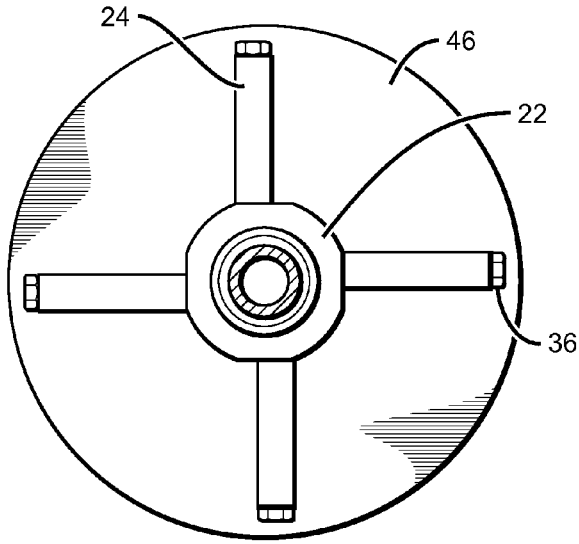
FIG. 4 is a top view illustrating the offset nozzle pipes taken along line 4-4 of FIG. 3.

Primary tool 10 comprises several components and is best illustrated by FIG. 2 and FIG. 3. A high pressure, high torque, low rpm rotary coupling 20 having a combination of high pressure seals and metal to metal rotary seals prevent feed water leakage. Rotary coupling 20 is model 20*k* BJV-20K manufactured by Stoneage Waterblast Tools, Durango, Colo., US. Below rotary coupling 20 is operably connected to a down hole tool comprising a tool body 22 having connected thereto a plurality of offset nozzle pipes 24 each having a distal discharge nozzle 36. The offset is best illustrated in FIG. 4 and is 0.25 inches off the center line of the tool body. The torque necessary for rotation of rotary coupling 20 is generated by the discharge exiting each nozzle 36. Nozzle pipes 24 extend away from tool body 22 in a perpendicular direction and face the inside wall of the well casing. Tool body 22 incorporates a bleeder port 52 for each nozzle.

As best illustrated in FIG. 5, each nozzle pipe 24 has a fluid entry 10 to 20 degree tapered inlet 30, an O-ring 32, threads 34, and distal nozzle 36. A conduit 38 connects inlet 30 to nozzle 36.

FIG. 6*a* is a side view of nozzle 36 and comprises a threaded stem 40 and a head 42. FIG. 6*b* is a top view of nozzle 36 illustrating head 42 and a cylindrical shaped tungsten carbide erosion protective insert 44 which press-fit into nozzle 36. Insert 44 is used to withstand the erosion forces generated, particularly resulting from the flow and turbulence immediately following jet contact with the casing wall. The inside diameter of insert 44 is about 0.142 inches. Also present is a precision cut cone 50 for funneling the flow from conduit 38 down to an exit orifice having a diameter of about 0.040 inch and made from either a commercial grade diamond or sapphire to withstand the erosion force generated by a 15,000 psi discharge stream. Nozzle 36 is made from stainless steel. FIG. 6*c* is a cut away view of nozzle 36 taken along line 6*c*-6*c* of FIG. 6*a* and illustrates the flow path for water.

The plurality of nozzle pipes 24 are offset in relation to tool body 22 in such a manner that the fluid discharge exiting nozzles 36 create a force to rotate tool body 22. Rotary coupling 20 incorporates a silicon based non-hazardous breaking fluid (not shown) and effectively maintains a steady rotating speed of between about 20 to 50 rpm when a flow rate of between about 30-70 gpm is maintained.

The vertical height of the cutting pattern is approximately 2" (using a tool body 22 with six nozzle pipes 24) to 3" (using a tool body 22 with eight nozzle pipes 24).

For different diameter wells, a respective length of nozzle pipe 24 is selected so that nozzle 36 is located between about 0.5 to about 2.5" from the inner wall of the perforated casing wall.

A centering disc 46 is located beneath tool body 22 to protect the nozzle pipes 24 from being crushed against the inner wall of the casing. Centering disc 46 is appropriately sized to allow for travel within a casing string while having a radius which is longer than each nozzle pipe 24. The diameter of centering disc 46 is slightly larger than the extent of nozzle pipe 24 from tool body 22 as shown in FIG. 8. Centering disc 46 ensures that nozzles 36 do not come in direct contact with the casing wall yet permits discharge nozzles 36 to come to within about 0.5 to about 2.5 inches.

In order to maintain a minimum friction loss and to promote a laminar flow stream exiting from each discharge nozzle, each exit port on the tool body, which has an inside diameter of about 0.303 inches, flows into the proximal end of a nozzle pipe 24 having an inlet taper of about 13±2° until the inside diameter of the nozzle tube is reached, preferably about 0.19 inches. The inside diameter of conduit 38 remains constant up to contact with discharge nozzle 36 located at the distal end. Each discharge nozzle 36 has a tapered configuration as best illustrated in FIG. 6*c* prior to fluid discharge.

Each nozzle pipe 24 is threadably secured to tool body 22 using straight threads to engage a metal to metal seal and sealed using "O" rings 32.

Tool body 22 is a compact component. For a 6 nozzle configuration, the vertical distance between the highest and lowest nozzle is about 2.25 inches; for an eight nozzle configuration, about 2.625 inches; and, for a 10 nozzle configuration, about 3.00 inches.

By minimizing the spacing of the jet pattern and pulling primary tool 10 to surface at a steady rate of about 1.0 to 2.5 feet per minute, the jet streams generated by the nozzle discharge effectively clean the inside diameter of the casing as well as into any existing perforations or past slots. It has also been discovered that an existing gravel pack is also cleaned. The fluid stream exiting from discharge nozzle 36 is at such a high pressure that the stream can extend through the perforations to break up pluggage also found incrusting the gravel pack. The possibility of damage to the casing is remote due to the relatively high rotational speed and slow vertical displacement of primary tool 10. Coupled with the fact that clean filtered well water is used, no abrasive is introduced that would facilitate hydro cutting of material that is far stronger than the energy used to open the perforations and reinvigorate the gravel pack.

Centering of primary tool 10 down hole is accomplished by employing a plurality of six aluminum or EPDM Centralizers 48 that are 24" long positioned above rotary coupling 20 and attached to a pre-determined length of rigid tubing 26, typically between 4-10 feet. This length is determined on-site which will be necessary to provide adequate centering of rotary coupling 20 and tool body 22 within the well casing. Rigid tubing 26 is connected upstream to coiled tubing 12 and downstream to rotary coupling 20. The flow path through coiled tubing 12, rigid tubing 26, rotary coupling 20 and tool body 22 minimizes friction loss during the pumping operation. Each centralizer 48 is appropriately selected for use in a well having a particular inside diameter in the same manner as is the length of nozzle pipes 24. As is well known in the art, the tool sizes have to take into account the down hole condition inside the casing including the buildup of fouling material to be encountered in the inside diameter of the casing and perforated casing walls.

Once primary tool 10 has been lowered to the starting depth, which is adjacent to the deepest perforations across the water zone, and the pumping process has been initiated, the operator adjusts the hydraulic reel to reflect the rate of retrieval speed by timing the reel with an onboard stop watch gauged against a depth counter (not shown) affixed to the tubular conveyance on the surface until the proper speed is attained. The pump is then throttled up to the desired pressure range of preferably between 15,000 psi-21,000 psi and the tool is retrieved at the rate of 1.0-2.5 feet per minute.

The connection used for the interfaces between the primary tool and the coiled tubing is a high pressure beveled, metal to metal seal. Pipe threaded connections are not recommended because of their unreliability above 14,500 psi. Therefore, all connections subjected to such high pressure, as well as the hose or tubular equipment used, must be designed to withstand extreme high pressure.

The process is capable of reaching depths of 3000 feet using 24 mm coiled tubing. The depth for which my invention can be used is limited to the currently available coiled tubing maximum diameter. 20 mm inside diameter coiled tubing can be used for shallow wells. However, with the flow rates and pressures used, backpressure is a major concern, and for depths between 1000 feet to 3000 feet, the inside diameter is preferred to be 24 mm.

When the tool has reached the upper limit of perforated casing, the pump is shut down and the tool is retracted from the well.

I claim:

1. An apparatus for cleaning the inside wall of a well casing having perforations across a known depth range and the well casing further having a known inner diameter, the apparatus comprising:

a primary tool comprising a rotary coupling, a rotatable tool body operably connected to and located beneath said rotary coupling, said tool body having a even plurality of offset elongated nozzle pipes extending away in a direction perpendicular to said tool body, each of said nozzle pipes having a distal end connected to a discharge nozzle for facing the inside wall, said nozzle pipes being of sufficient length so that said discharge nozzles are positioned to be between about 0.5 to 2.5 inches from the inside wall, each of said discharge nozzles appropriately sized to deliver a high pressure discharge of at least 15,000 psi at a flow rate of between about 5-7 gpm;

a hydraulically driven reel for unwinding and retracting a pre-determined length of coiled tubing having proximal and distal ends, said coiled tubing capable of withstanding an internal pressure of at least 15,000 psi, said distal end operatively connected to said primary tool and said coiled tubing of sufficient length to lower said primary tool to the known depth;

a pump connected at its discharge to said proximal end of said coiled tubing, said pump capable of pumping at a pressure of at least 15,000 psi; and, where said discharge nozzles each contain a press-fit funnel incorporating a discharge orifice having a diameter of about 0.040 inches.

2. The apparatus of claim 1 where said discharge orifice is made from a commercial diamond.

3. The apparatus of claim 1 where said discharge orifice is made from a commercial sapphire.

4. The apparatus of claim 1 where said discharge nozzles each contain a cylindrical erosion protective insert press-fit into the discharge side.

5. The apparatus of claim 4 where said cylindrical erosion protective insert is constructed of tungsten carbide.

6. The apparatus of claim 1 further comprising a centering disc connected to and beneath said tool body, said centering disc having a diameter less than that of the well casing but having a diameter larger than the distance said discharge nozzle is from the center of said tool body.

7. The apparatus of claim 6 where said centering disc has a diameter about 0.5 inches less than the inside diameter of the casing at-depth.

8. The apparatus of claim 1 where the number of said even plurality of nozzle pipes is six.

9. The apparatus of claim 1 where the number of said even plurality of nozzle pipes is eight.

10. The apparatus of claim 1 where the number of said even plurality of nozzle pipes is ten.

11. The apparatus of claim 1 where each said nozzle pipe is located at a different vertical height from the other said nozzle pipes.

12. The apparatus of claim 1 where said high pressure discharge is laminar.

13. A method for cleaning the perforations of a well where the well has a known casing inside diameter and a known range of downhole perforations, the method comprising the steps of:

providing a water source and a pump capable of pumping between about 50-70 gpm at a pressure in excess of 15,000 psi;

providing a tool body having a plurality of discharge nozzles arranged to be offset from the centerline of said tool body, each discharge nozzle appropriately sized to permit a flow rate of between about 5-7 gpm at a pressure in excess of 15,000 psi, and a rotary coupling operatively connected above said tool body to limit the rotation of said tool body to between about 20-50 rpm when the flow rate through each said discharge nozzle is between 5-7 gpm;

providing a flow path from said pump to said tool body;

lowering said tool body and said rotary coupling so said discharge nozzles are adjacent to the lowermost depth of the downhole perforations;

pressurizing said coiled tubing to at least 15,000 psi; and, retracting said primary tool at a rate of between about 1.0-2.5 fpm across said known depth range of perforations.

14. An apparatus for delivery of a cleaning fluid for cleaning the inside wall of a well casing having down hole perforations across a known depth range and the well casing further having a known inside diameter, the apparatus comprising:

a tool body having an outside diameter adapted to pass through the inside diameter of a well casing, said tool body having an intake orifice and a plurality of exit ports, each of said exit ports offset from the center line of said tool body and further define the intake stream for a respective discharge nozzle, each of said discharge nozzles positioned to face the inside wall of a well casing and further having a unique vertical position on said tool body, each of said discharge nozzles being adapted with a cylindrical erosion protective insert and a conical shaped insert positioned upstream of said erosion protective insert, said conical shaped insert having a discharge end diameter sized for a flow rate through said insert of between about 5-7 gpm at a pressure of greater than 15,000 psi; and, a centering disc attached beneath said tool body, said centering disc having an outside diameter adapted to pass through the inside diameter of a well casing but larger than said outside diameter of said tool body.

15. The apparatus of claim 14 further comprising a rotary coupling having an intake orifice, a discharge orifice, and an inside diameter flow path equivalent to said intake orifice of said tool body and operatively connected to the intake orifice of said tool body, said rotary coupling capable of retarding the rotation of said tool body to between about 20-50 rpm when a flow rate of between about 30-70 gpm is passing through said rotary coupling.

16. The apparatus of claim 15 further comprising a predetermined length of rigid tubing operably connected on one side to the intake orifice of said rotary coupling, said rigid tubing further having at least one centralizer secured about said rigid tubing and having an outside diameter adapted for use in the well casing.

17. The apparatus of claim 16 further comprising a predetermined length of coiled tubing having proximal and distal ends, said distal end operatively connected to said rigid tubing.

18. The apparatus of claim 17 further comprising a water source and a pump where said pump is operatively connected to the proximal end of said coiled tubing and is capable of a fluid displacement of between about 30-70 gpm at a pressure in excess of 15,000 psi.

19. The apparatus of claim 18 where said coiled tubing is attached to a hydraulically powered reel.

20. The apparatus of claim 14 where connected to each of said exit ports is a respective nozzle pipe having an inlet taper of about 13±2° to an inside diameter of about 0.19 inches which is connected to a respective discharge nozzle.

21. The apparatus of claim 14 where each of said discharge nozzles are positioned no more than 2.5 inches from the inner wall face of the casing at the known depth range.

22. The apparatus of claim 14 where each said discharge nozzle is located at a different vertical height from the other said nozzle pipes.

23. The apparatus of claim 14 where the discharge from each of said discharge nozzles is laminar for a flow rate of between about 5-7 gpm at a pressure of greater than 15,000 psi.

24. A method for cleaning the perforations of a well where the well has a known casing inside diameter and a known range of downhole perforations in the casing wall, the method comprising the steps of:

providing a water source and a pump capable of pumping between about 30-70 gpm at a pressure in excess of 15,000 psi;

providing a retractable flow path from said pump to the downhole perforations; and, means to deliver an even plurality of discharge streams onto the inside casing wall at a rate of between about 5-7 gpm at a pressure in excess of 15,000 psi while the rotation of said discharge streams is limited to between about 20-50 rpm.

25. The method of claim 24 where said retractable flow path comprises coiled tubing attached to a reel, said reel can be retracted at a rate of between 1.0-2.5 fpm across said known depth range of perforations.

* * * * *